US006532625B1

(12) United States Patent
Stone

(10) Patent No.: US 6,532,625 B1
(45) Date of Patent: Mar. 18, 2003

(54) UNIVERSAL MOUNTING TRACK

(76) Inventor: Pam Stone, 104 Taylors Rd., Taylors, SC (US) 29687

( * ) Notice: Subject to any disclaimer, the term of this patent is extended or adjusted under 35 U.S.C. 154(b) by 183 days.

(21) Appl. No.: 09/620,010

(22) Filed: Jul. 20, 2000

(51) Int. Cl.[7] ..... A47H 13/00

(52) U.S. Cl. ..... 16/87.4 R; 16/95 R; D25/119; 160/84.1 C

(58) Field of Search ..... 16/87.4 R, 87.2, 16/95 R; D8/102, 377; D25/119, 102; 160/237, 345, 84.1 C, 330; 49/504; 248/263

(56) References Cited

U.S. PATENT DOCUMENTS

| | | | | |
|---|---|---|---|---|
| 840,282 | A | * | 1/1907 | Adamowicz |
| D165,937 | S | | 2/1952 | Rosenbaum |
| 3,715,776 | A | | 2/1973 | Tanaka |
| 3,871,082 | A | * | 3/1975 | Pflum |
| 4,120,474 | A | * | 10/1978 | Hurley |
| D287,057 | S | * | 12/1986 | Bancroft |
| D311,583 | S | * | 10/1990 | Shell |
| 5,323,834 | A | * | 6/1994 | Toti |
| 5,392,833 | A | * | 2/1995 | Ohanesian |
| D359,565 | S | * | 6/1995 | Hallsten |
| D381,890 | S | | 8/1997 | Levy |
| 6,219,892 | B1 | * | 4/2001 | Johnson |

* cited by examiner

*Primary Examiner*—Gary Estremsky
*Assistant Examiner*—Mark Williams
(74) *Attorney, Agent, or Firm*—McNair Law Firm, P.A.

(57) ABSTRACT

A rigid, one piece mounting track with mounting and suspension slots for carrying multiple functional and decorative hangings simultaneously. The track has generally U-shaped construction with two vertical legs joined by a horizontal member. An elongated dowel holder forms the joint between one leg and the horizontal member. The other leg has inner and outer elongated slots for carrying mounting slides. The inner surface of the horizontal is also provided with a mounting slot for additional hangings.

23 Claims, 11 Drawing Sheets

UNIVERSAL MOUNTING TRACK

FIELD OF THE INVENTION

This invention relates to a multi-functional, multi-positional mounting track which will accommodate a wide variety of devices that in turn, carry decorative and functional hangings including draperies, tapestries, blinds, curtains, sheers, shades and the like.

BACKGROUND OF THE INVENTION

As long there have been windows and walls there has been a desire and need for coverings which are either decorative or functional or both. For windows, a covering is usually very desirable and items such as roll-up shades, venetian blinds, vertical blinds, draperies, or sheers are often employed. Various means have been employed to suspend these window coverings and they range from simple bearing like holders for roll-up shades to elaborate mechanisms for carrying layers of draw drapes. Unfortunately, many of these "prior art" hangers are flimsy in nature and serve only a single purpose. Accordingly, it is one object of the present invention to provide a means of supporting and carrying window coverings and window treatments which can be permanent, provide secure support for heavy covering items, withstand long term wear and tear, and be adaptable for many types of hangers and support devices.

In addition to treatment for windows, it is often desirable to hang tapestries or other decorative items from a wall and provide layered hangings for interesting effects. For example, lighting in connection with such wall treatments is often used. Accordingly, it is another object of the present invention to provide a mounting track that can not only be used for windows but can also be used for decorative and functional item on walls.

In the past there have been numerous designs for various hanging devices to hold window and wall treatments but a number of these have been single function hangers or rods and some are provided with extension pieces and connectors for additional hanging items. One such device is shown in U.S. Pat. No. 4,120,474 to A. Hurley for "Drapery Support Assembly." However, such assemblies as this require many parts and difficult assembly and are of uncertain stability when installed because of the extensions and number of bolted together parts. Accordingly, it is another object of the present invention to provide a one piece mounting track that is secure and stable.

Another prior art device is shown in U.S. Pat. No. 3,715,776 to M. Tanaka for a curtain box which apparently provides one track for hanging curtains but the means for mounting appears complex and there is no provision for covering or decorating the curtain box. Accordingly, it is another object of the present invention to provide a mounting track that can be covered and substantially hidden from view but will perform multiple functions.

One means for decorating is to use a curtain or drape that has a looped end so that a dowel can be inserted therein for hanging. One such device is shown in U.S. Design Pat. No. 165,937 to H.S. Rosenbaum entitled "Drapery Traverse Rod." However, this type of traverse rod is capable of handling only one decorative hanging at a time. Another prior art device which apparently is for hanging dowel supported draperies is U.S. Design Pat. No. 311,583 to Irving Shell and is entitled "Extrusion." This extrusion has features that could be construed to be designed for carrying dowels but the extrusion does not seem to provide for any other type of hanging. Again, it is an object of the present invention to provide not only a means for holding a dowel but means for holding other decorative hangings at the same time.

Still one more prior art design is U.S. Design Pat. No. 381,890 to Israel Levy entitled "Blind Track." Here again, while there appears to be more than one track, it seems to be directed to adjustment for different size blinds rather than providing for multiple hangings. Numerous other prior art devices can be discussed but none of them have the combined advantages of my invention which are described below.

SUMMARY OF THE INVENTION

I have surprisingly combined and arranged in a unique fashion a mounting track that overcomes many of the drawbacks of prior art devices. Specifically, my invention is a universal mounting track for decorative and functional hangings including draperies, tapestries, blinds, sheers, curtains and the like which comprises an elongated base member having a generally U-Shaped cross-section that includes a horizontal connector and two spaced apart legs vertically depending from the connecting member. One of the legs is an inner leg having a smooth flat outer surface for contacting a support surface and; an elongated dowel holder is formed in the outer surface of the base and extends the length of the base, the dowel holder forms the joint between the inner leg and the horizontal connector and has an elongated opening for receiving a dowel therein. The opening faces generally away from the horizontal connector member whereby when a dowel with fabric therearound is inserted in to the holder, the fabric can extend out of and over the horizontal connector while the dowel is retained by the holder. The other leg is an outer leg having at least one elongated slot formed in its surface for receiving and holding one or more slidable mounting members therein that can suspend draperies, curtains, or the like. A unique feature of my invention is that multiple hangings may be suspended in a functioning array in just one track.

In one aspect, the foregoing described universal mounting track may be a one piece extruded construction. Particularly advantageous is aluminum, especially anodized aluminum. The one piece extruded construction provides a very stable mounting track.

The mounting track includes within the U-shaped base two elongated slots for receiving mounting elements or clips of the type well known in the art and available at most hardware stores, home supply stores, drapery shops and fabric stores. One of the slots is preferably in the outer leg inner surface and the other slot is in the inner surface of the horizontal connector. The slot in the horizontal connector is also provided with a channel to provide extra depth for locking nut and bolt extensions. The front surface or outer surface of the outer leg is also provided with a slot for mounting. Counting the dowel as one hanging means, three additional hanging means are provided. Thus, decorative fabric supported by the dowel could cover and extend part of the way down the front or outer surface of the universal track while draw drapes could be suspended from the outer leg outer slot and sheers from the inner slot of the outer leg while blinds are suspended from the slot in the horizontal connector. The strength and stability of my track allows all of these functions in one track for secure and reliable operation.

The universal track of the present invention can also be used in different positions and in one unique position the legs extend upwardly and the track forms a tray for lighting. In addition, the track may be suspended from the ceiling or upper horizontal surface by mounting members through the horizontal connector. The rigidity, stability, and the durability of the extruded one piece construction allows for versatility not available in prior art mounting tracks.

Still other decorative uses are possible with my mounting track. A valance board may be suspended or positioned in the front or outer slot of the outer leg. My mounting track has sufficient strength to hold not only a valance but additional heavy hangings such as weighted drapes or Venetian blinds and obviates the necessity for additional suspension means with their required drilling and bolting or screwing into walls or window frames. My universal mounting track makes it possible to provide all of these functions with one single track which can be mounted in a permanent position without having to use additional tracks or hangers. This is of great advantage to not only homeowners, but those who decorate offices, shops, hotels and other buildings. Further advantages will be understood from the drawings and descriptions below.

DESCRIPTION OF THE DRAWINGS

In the drawings which are appended hereto and made a part of the specification and disclosure.

DETAILED DESCRIPTION OF A PREFERRED EMBODIMENT

Figure 1:
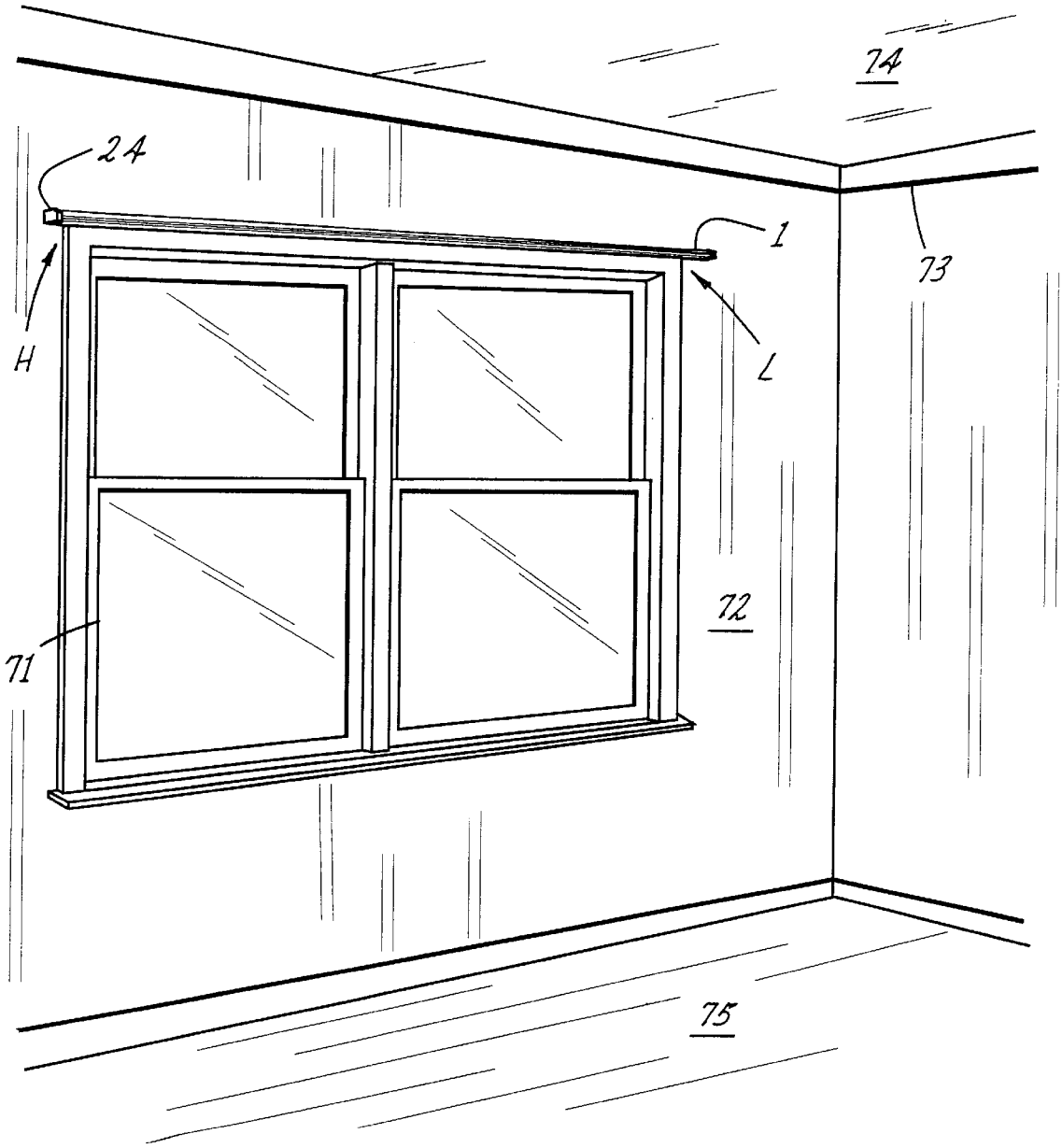
FIG. 1 is an illustration in perspective of a typical room with windows showing the universal mounting track of the present invention installed.

Looking first at FIG. 1, a typical room is shown with wall 72 and window 71 therein. Above the window is the preferred position of installing the universal mounting track 1 of the present invention. End cap 24 closes the ends of the track and as can be seen in this illustration the track blends in and fills the space above the window and preferably is a permanent installation. In an alternate position, the track 1 can be moved upwardly and positioned on or just below the molding 73 which runs between the wall 72 and ceiling 74. Thus, the track 1 can provide a means of hanging decorative materials from the ceiling 74 to the floor 75. The track can also extend the entire length of the wall and be integrated in with the appearance of molding so that the option is always available to hang not only draperies, curtains, and tapestries, but also install and suspend other decorative treatments such as murals, stained glass or framed pictures. These options are always available once my mounting track has been installed.

For example, a mounting screw orifice 10 (FIG. 2) may be provided at the latch end. The securing screw can then be removed so that the hinged track can swing outwardly. The purpose for a hinge mount is to provide a way to remove or insert a long dowel when the track has been mounted so that there are walls or other obstructions close to both ends of the track preventing insertion of a dowel.

An alternate mounting means and method is to hingedly mount the track 1 at point H and provide a releasable latch at point L. The hinge is preferably a typical door or cabinet door hinge as is well known and can be installed with the hinge pin vertically positional at the edge of the track 1 at point H with one hinge flange mounted to the wall and the other to track leg 4. A locking or securing latch or screw at L is preferred.

Figure 2:
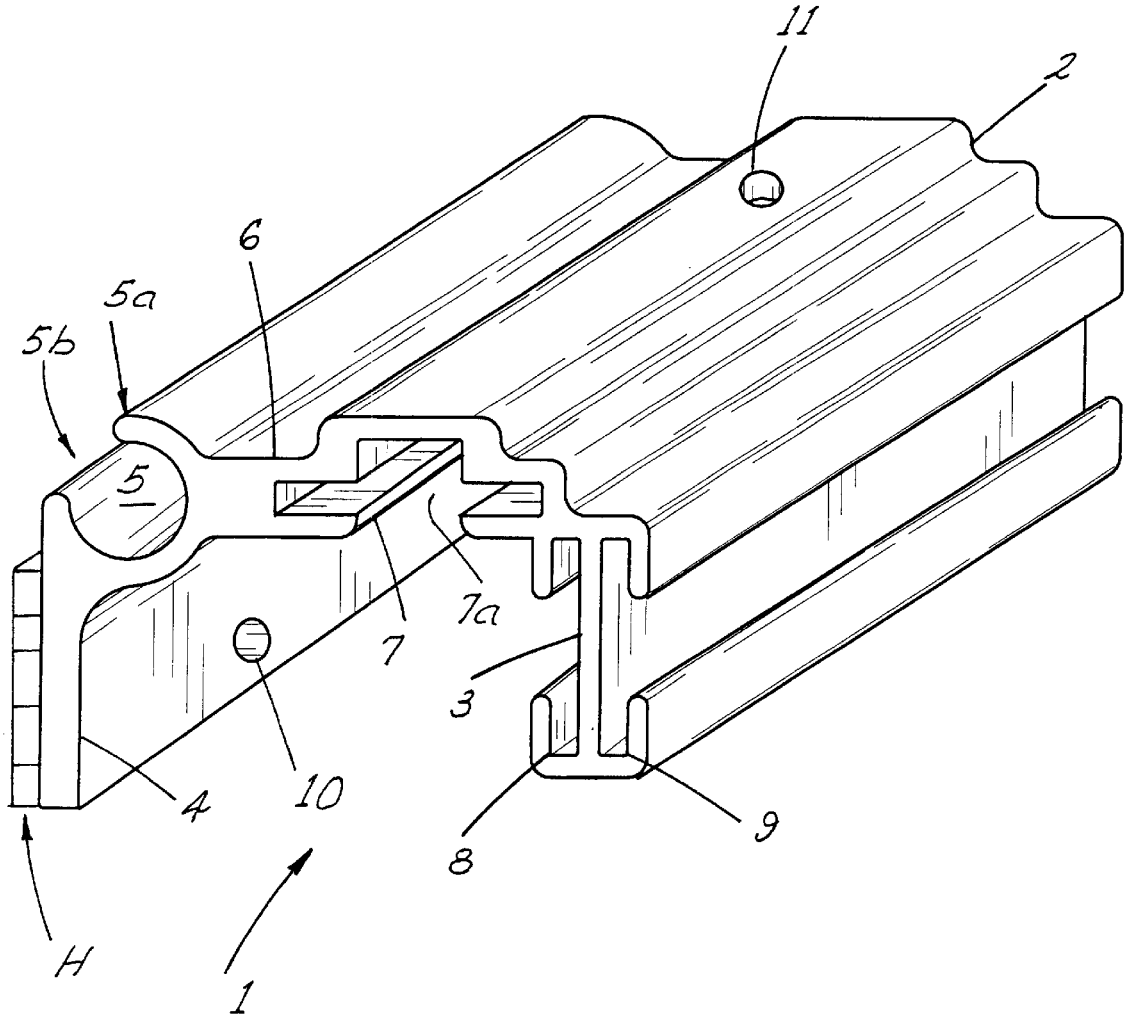
FIG. 2 is a perspective view showing one end and partial length of the mounting track.

Turning now to FIG. 2 the preferred embodiment of my invention is shown in a detailed perspective illustration. The universal mounting track 1 is shown with the generally U-shaped base frame 2 having spaced apart legs 3 and 4 depending therefrom. Vertical leg 4 is also designated as the inner leg as it is the leg which when the mounting track 1 is installed on a wall will be against the wall so that vertical leg 4 has a smooth outer surface which is a contact surface. The joint between vertical leg 4 and horizontal connector 6 is formed by dowel holder 5 which comprises the retainer lip 5*a* and the dowel holder opening 5*b*. The dowel opening 5*b* allows the insertion and removal of a dowel and the lip 5*a* is the retainer lip so that when the dowel is inserted in its material suspending position the material will be looped back over the dowel lip which will retain the dowel in its position. Thus, the opening 5*b* being faced away from the way in which the material will be folded provides a secure means of retaining the dowel and attractively covers the universal track.

The horizontal connector 6 which is the top of the U-shaped base frame 2 from which legs 3 and 4 depend has slot 7 formed therein. Slot 7 which is the connector slot or first longitudinal slot. Within the slot 7, within the slot's top surface, is formed a longitudinal channel designated slot 7*a* which provides additional options in selecting the types of hangers which may be inserted and slid along the slot. Thus, the channel or slot 7*a* will allow the protrusion of the bolts and screws above the general top of the slot.

Vertical leg 3 is designated as outer leg 3 and in its inner surface is formed longitudinal slot 8 and in its outer surface longitudinal slot 9. Both of these slots are adapted for carrying various supporting or in hanging items. The shapes of all of these slots may vary in size, and dimension and be proportioned to receive the popular hangers and fasteners of the type found in home supply and drapery shops.

Universal mounting track 1 is preferably one piece of extruded metal. The metal of choice is aluminum, particularly, anodized aluminum. Specifically, the preferred embodiment has an overall height of about 2¼ inches and the width from the outside of the vertical leg 4 to the outside of the second slot or outer slide on the leg 3 is about 3½ inches. The dowel holder diameter is preferably about ⅝" to 11/16" inches and the opening or gap 5*b* is about in the order of about ⅜" to 7/16 inches. The slot openings are approximately ½" to ⅝" inches with a depth of about ⅛" to 3/16". The surface of the track is machined smooth without snags or spurs. The thickness of leg 4 is about 3/16". Drilled holes 10 and 11 are provided for screws to go into wall studs for secure mounting. The holes are readily drilled to match the position of studs or other structural member into which the mounting screws are fastened. The preferred aluminum is readily cut in lengths that are suitable for installation so that a custom fit is available with tools which the typical homeowner or handy man is familiar and has readily available. For installation on the full length of a wall, one end of the track is preferably hinge mounted as described above so it will swing outwardly to allow easy insertion and removal of the dowel from the dowel holder.

Referring back to FIG. 2 briefly, as mentioned above, leg 4 may be about 3/16" in thickness but depending upon the materials selected can be of thicker or thinner dimensions. Likewise, horizontal member 6 may be as thick as ⅜" and outer vertical leg 3 may be about ⅛" thickness. These dimensions may be varied but the important feature is to retain rigidity and stability which the preferred extrudable aluminum does with the foregoing dimensions.

Figure 3:
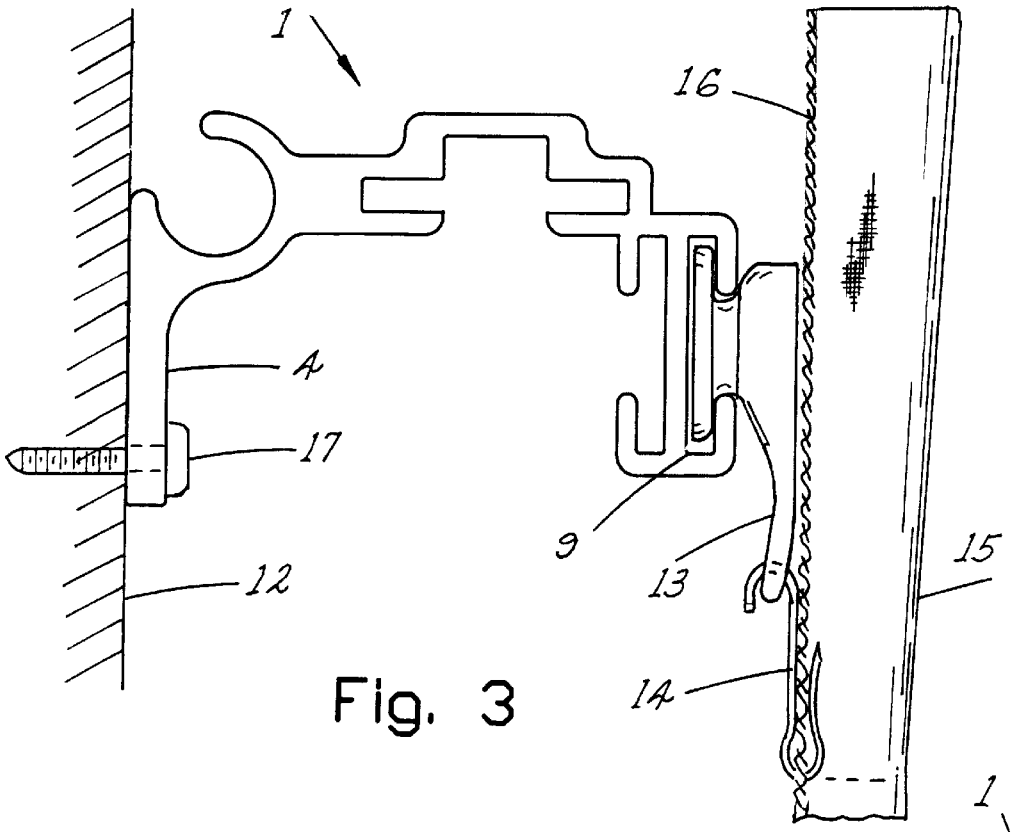
FIG. 3 is a perspective cross-section showing the mounting track of the present invention mounted to a wall and carrying a drapery.
Figure 4:
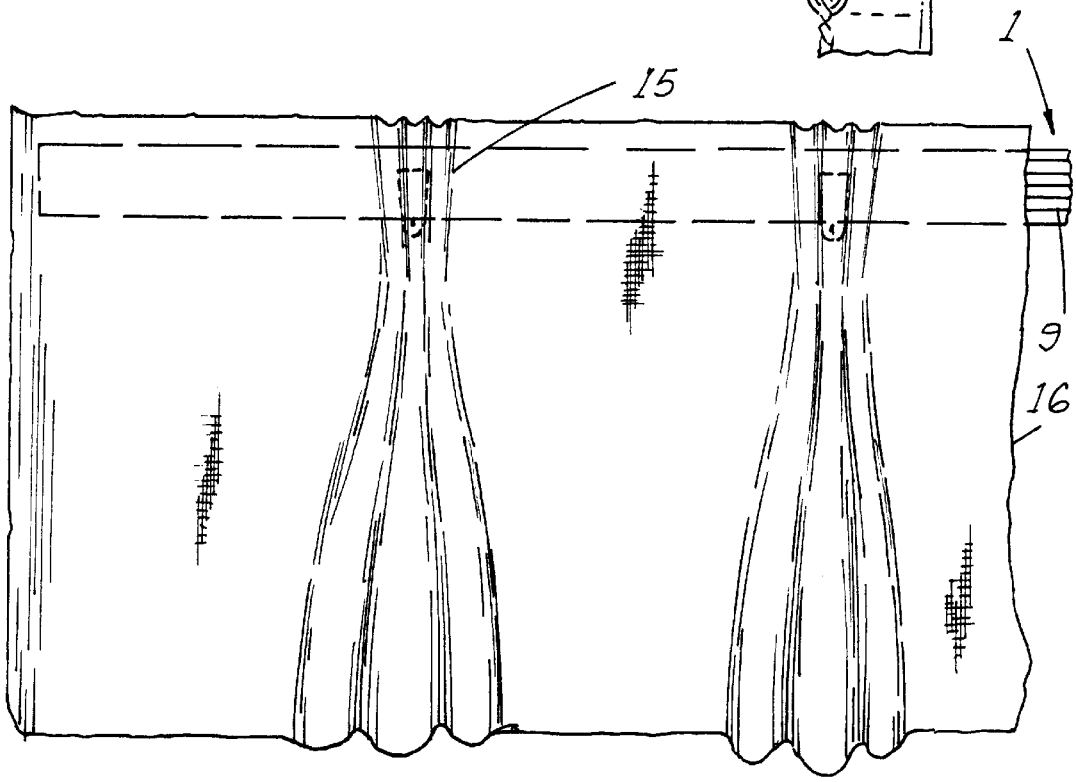
FIG. 4 is the frontal elevation view of FIG. 3.

Turning now to FIG. 3, universal track 1 is shown installed on wall 12. Preferably screw 17 extends into a wall stud or other structural member. Inner leg 4 is shown secured flat against the wall 12. At the other side of the track 1, molded side 13 is shown in the outer mounting slot 9 which is also designated as the third mounting slot. The molded slide may be, for example, a molded slide according to any of parts 3908, 3909, or 3909B from Kirsch Division of Newell Rubbermaid and are available from their suppliers such as United Supply Co. of Charlotte, N.C. (Other suppliers have acceptable mounting sliders of various configurations available as is well known in the art.)) Mounting hook 14 or drapery hook is suspended from the mounting clip 13 and is secured in the upper gathered reinforced portion of the drapery 15 which can be appreciated from the front view in FIG. 4 which shows drape 16 in its position. This is one of the many uses of the universal mounting track.

Figure 5:
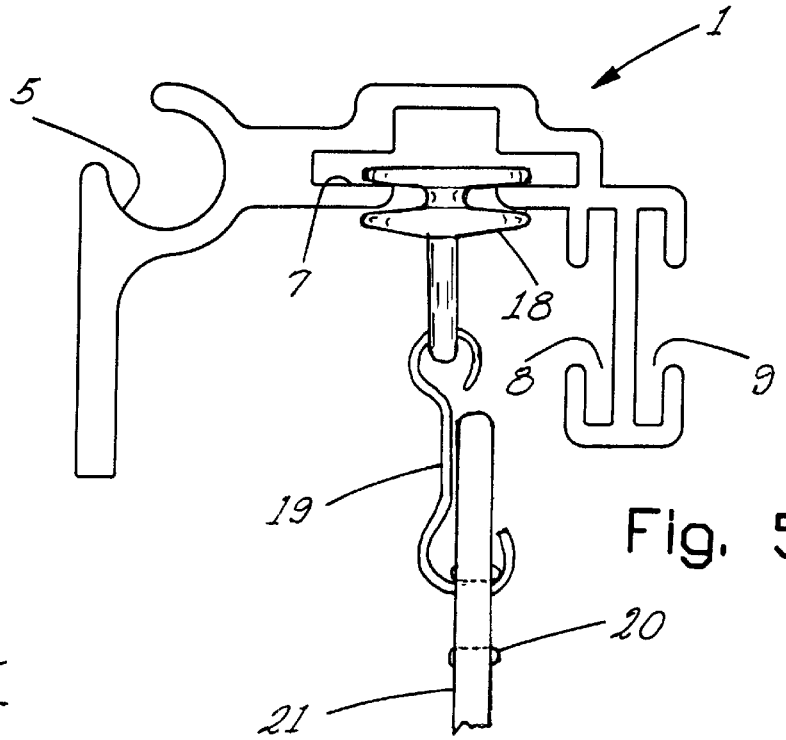
FIG. 5 is a perspective cross-section view of the track of the present invention showing a drapery suspended from the mounting slot of the horizontal connector.
Figure 6:
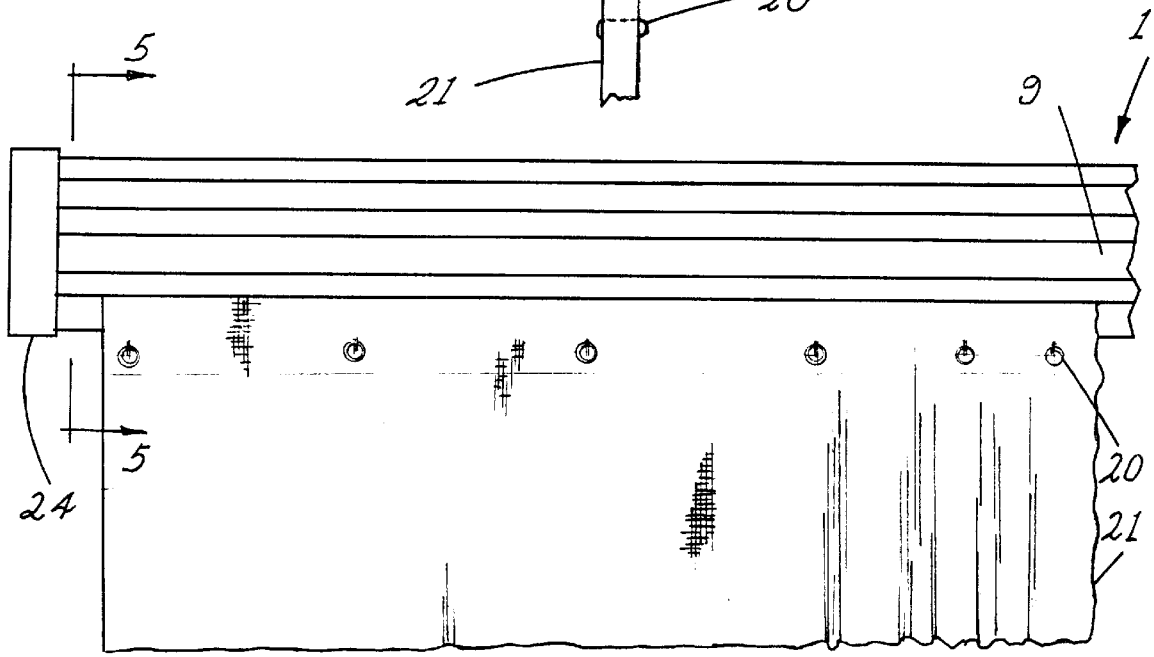
FIG. 6 is the front view of FIG. 5.

In FIGS. 5 and 6 the suspension of a drape or sheer or other decorative item is illustrated. In FIG. 5 the horizontal mounted slide 18 is shown deposed in slot 7 and in this position it is carrying the drapery eyelet hook 19 which suspends the drapery 21 that has the eyelets 20 formed in it to receive the hook 19. (This slide can be 9406 or 9412 from the previously mentioned Kirsch Division as one example of a supplier.) Rather than a drape this may also be a sheer or opaque curtain as the individual decorator may wish to choose for an installation. The slots 8 and 9 are available for hanging additional decorative or functional items.

Figure 7:
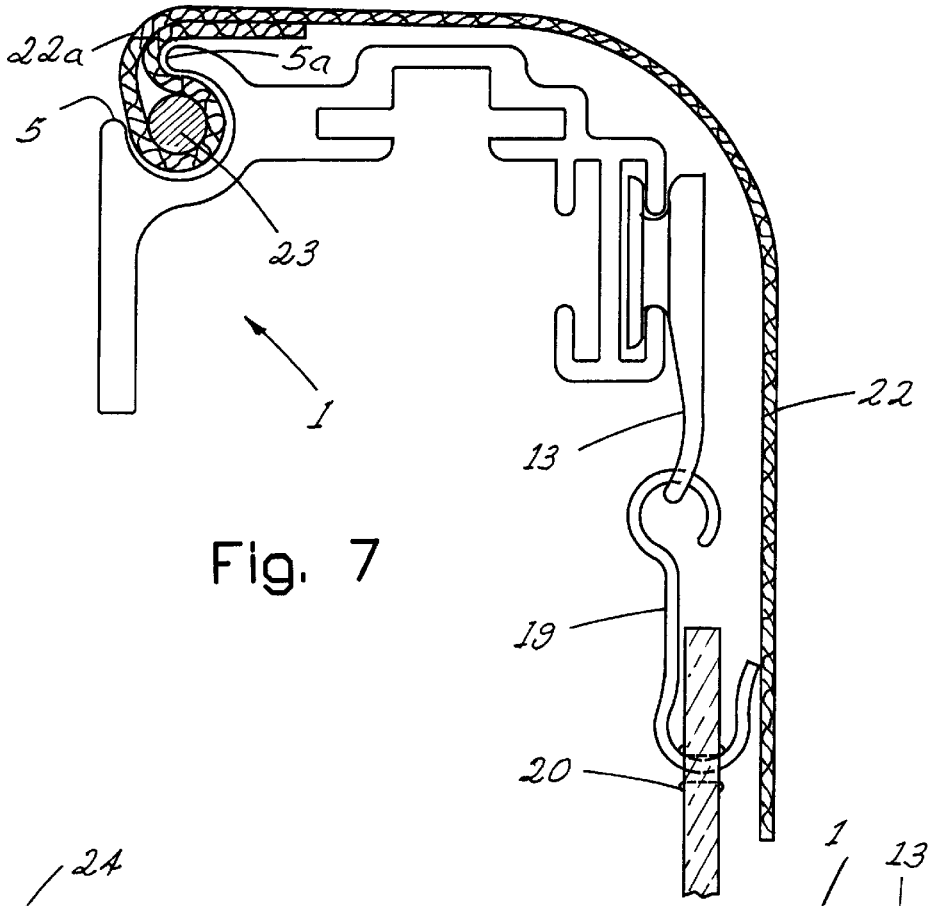
FIG. 7 is a perspective cross-section of the universal track of the present invention showing a decorative material held by a dowel positioned in the dowel holder of the present invention wherein the material extends over and covers the exposed surfaces of the universal track and the outer slot carries drapery material.
Figure 8:
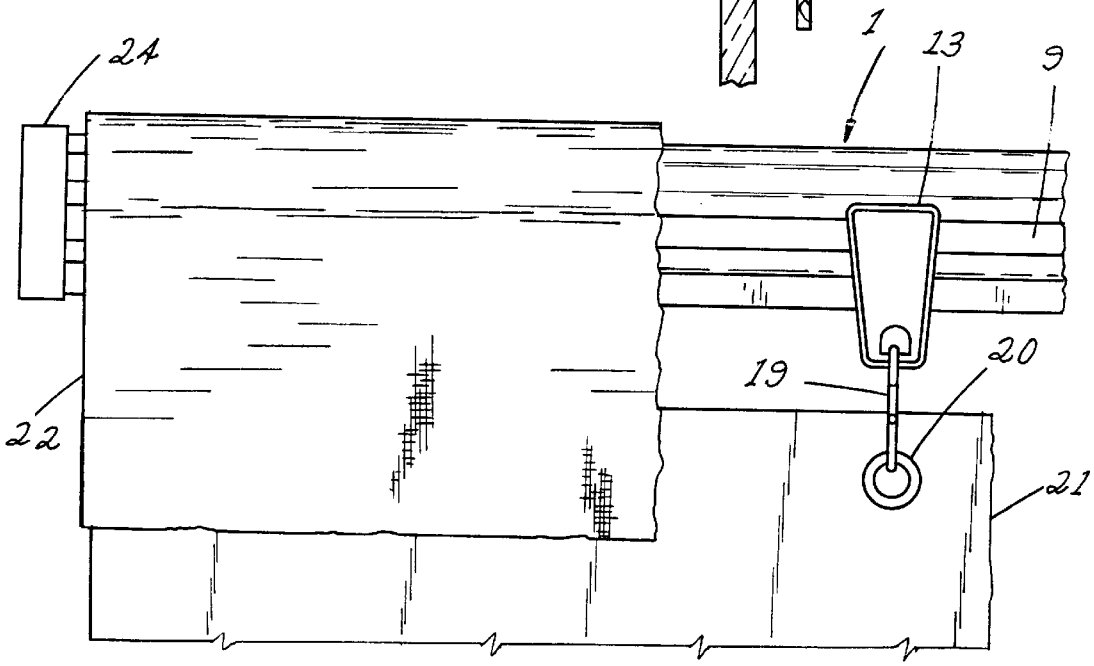
FIG. 8 is the front view of FIG. 7.

Looking now at FIGS. 7 and 8, the function of the dowel holder 4 using decorative material to cover the universal track will be appreciated. Dowel 23 is shown inserted in the dowel holder 5 with flexible decorative material or coverlet 22 forming a loop 22*a* around the dowel. The opening of the dowel holder 5 faces away from the connector and the outer leg. The lip 5*a* holds and retains the coverlet 22 in its correct position. As can be seen, the coverlet can be designed so that it has a length sufficient to cover the drapery hook 19 and eyelet 20 so that these cannot be seen. The arrangement as shown on the left hand side of FIG. 8 is presented. The coverlet 22 is partially cut away in FIG. 8 to show the hanger and hook arrangement. The unique versatility of my universal track and the decorating options it provides are readily appreciated in this configuration.

Figure 9:
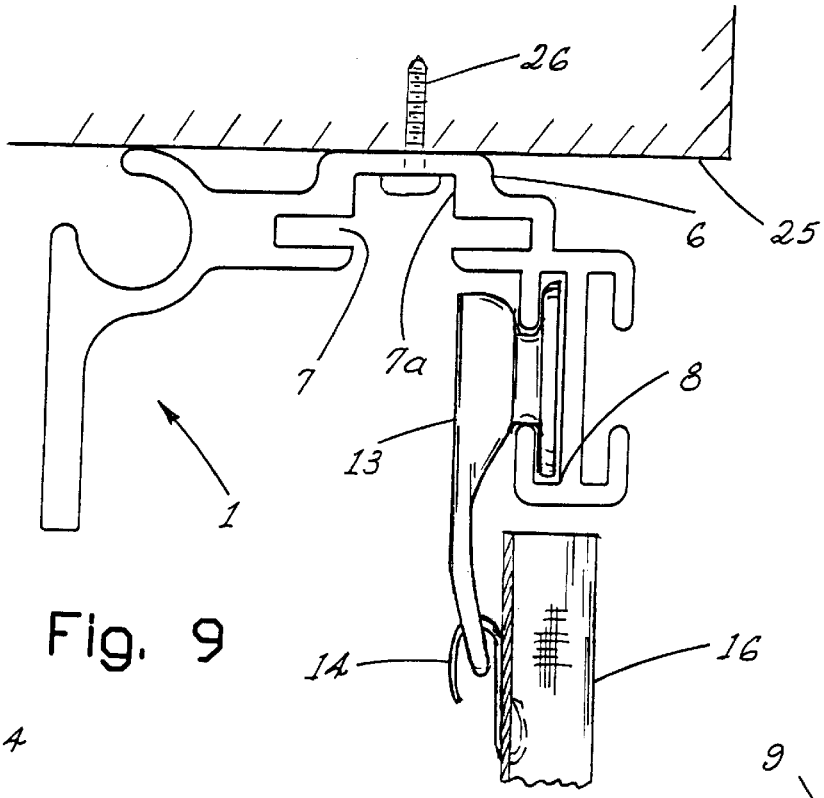
FIG. 9 is a perspective cross-section showing the universal mounting track suspended from a ceiling or horizontal surface.
Figure 10:
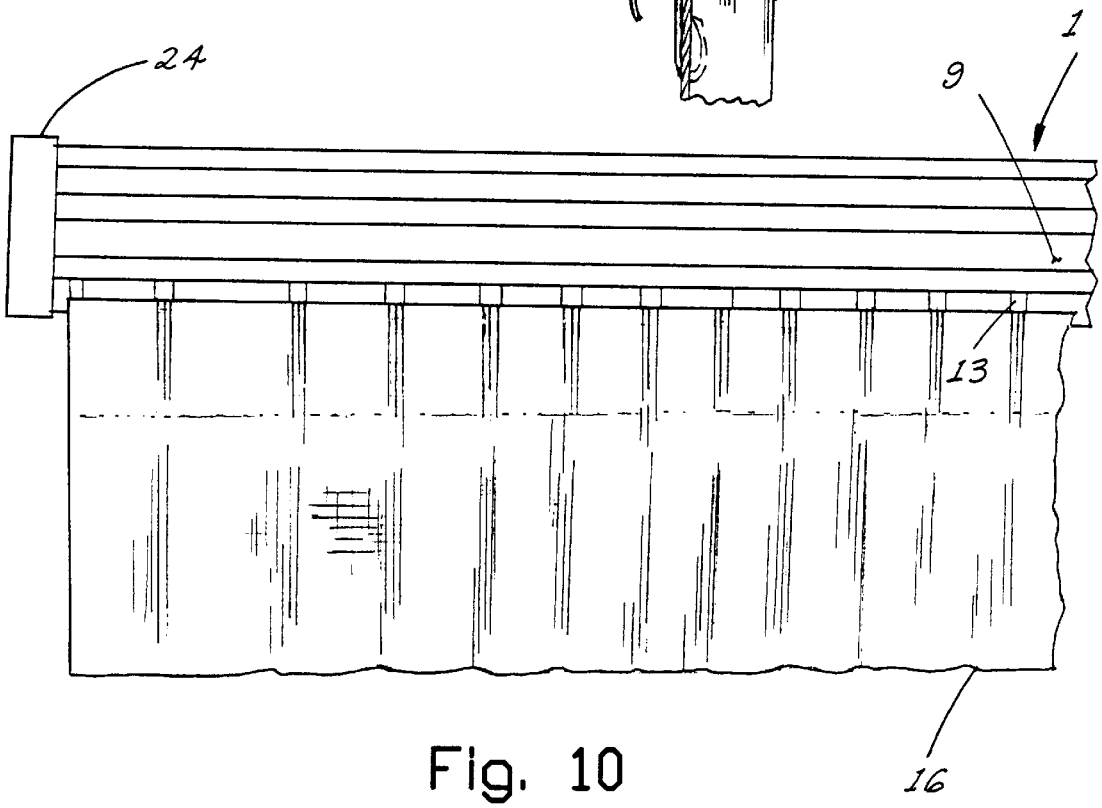
FIG. 10 is the front view and elevation of FIG. 9.

FIGS. 9 and 10 show an alternate arrangement of the universal mounting track wherein it is secured with fastener 26 to the ceiling 25 or upper horizontal surface. Here, fastener 13 traveling in second slot 8 or inside slot on the outer leg 3 is carrying the mounting hook 14 which is hooked into drape 16 at a gathered pleat. The frontal view is shown in FIG. 10. The front appearance of outer or third mounting slot 9 can be seen here and an additional feature of my invention is that a color coordinated insert can also be inserted in the slot to improve the appearance of the arrangement.

Figure 11:
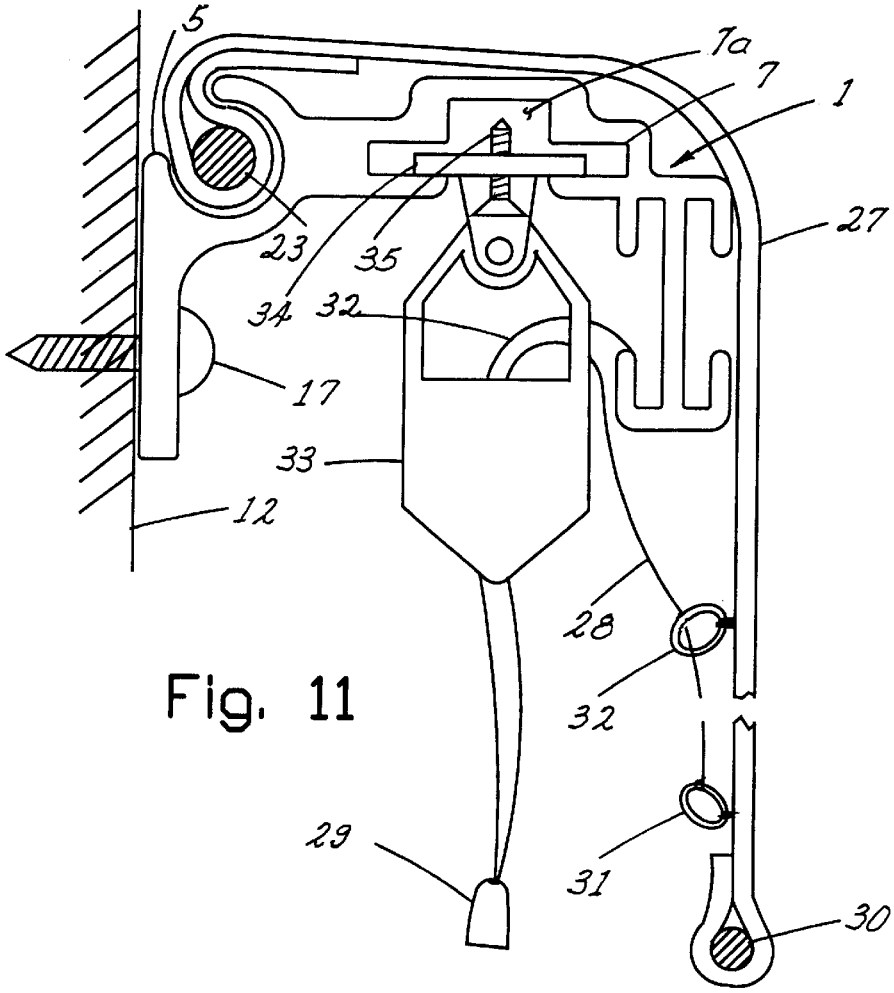
FIG. 11 shows a cross-section view in perspective of the universal mounting track carrying a theater style curtain and illustrates the pulley and connector means for raising and lowering the curtain.
Figure 12:
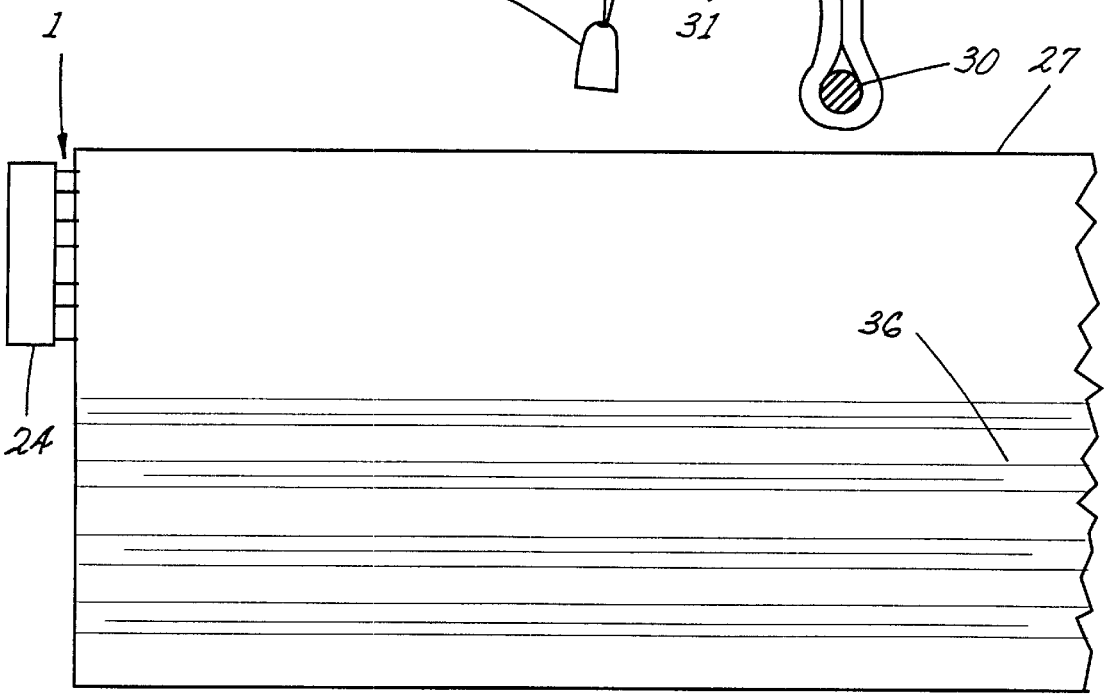
FIG. 12 is the front view of FIG. 11.
Figure 13:
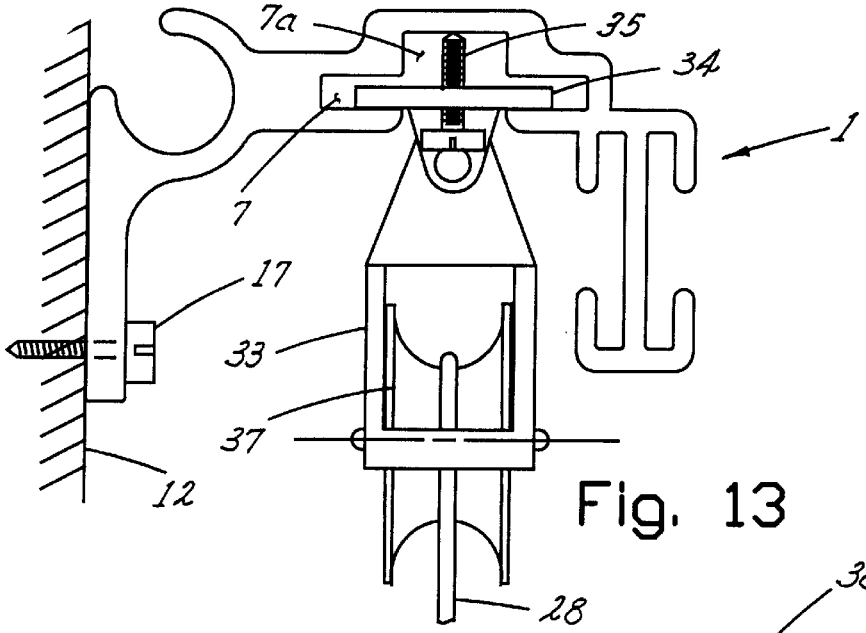
FIG. 13 shows the pulley arrangement of FIG. 11 with the pulley turned sideways to show the pull cord arranged therein.

In FIGS. 11, 12, and 13, a weighted theater style curtain 27 is shown wherein the lower end of the curtain is held by weighted end loop 30 and the other end of the curtain is secured by dowel holder 5 as it is held with dowel 23. Attached to the lower end of the curtain is ringlet 31 to which the pull cord 28 is attached and it passes through guiding ringlet 32 on its way to crossing over pulley 37 which is held within pulley housing 33 as shown in FIG. 13. The pulley housing is secured within slot 7 and the adjusting or anchoring screw 35 locks the support washer 34 as it is tightened down against the surface of channel 7*a*. As can be seen in FIG. 12, the curtain has horizontal pleats or fold lines to form an accordion type pleated fold as it is pulled upwardly by a downward pull on pull cord handle 29.

Figure 14:
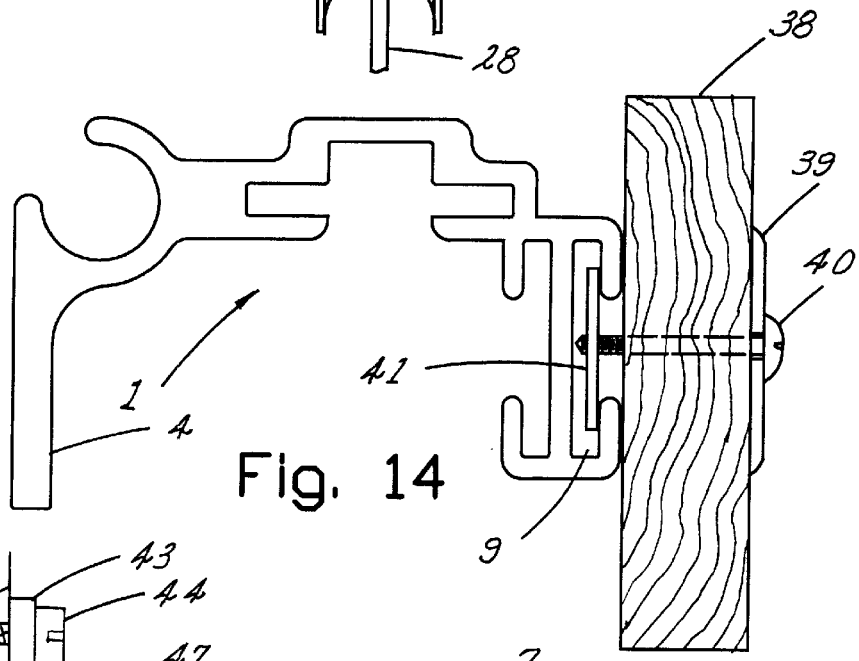
FIG. 14 is a side view of the present invention showing a valance board suspended or carried thereby.

FIG. 14 shows valance 38 mounted with retaining washer 39, bolt 40 and locking washer nut 41 disposed within the third hanger slot 9. The rigidity and stability of my universal mounting track permits the mounting of a valance or other heavy decorative item. For example, member 30*a* could be a piece of molding and the bolt and washer could be recessed or color-coded with the molding to provide still another attractive use of my mounting track.

Figure 15:
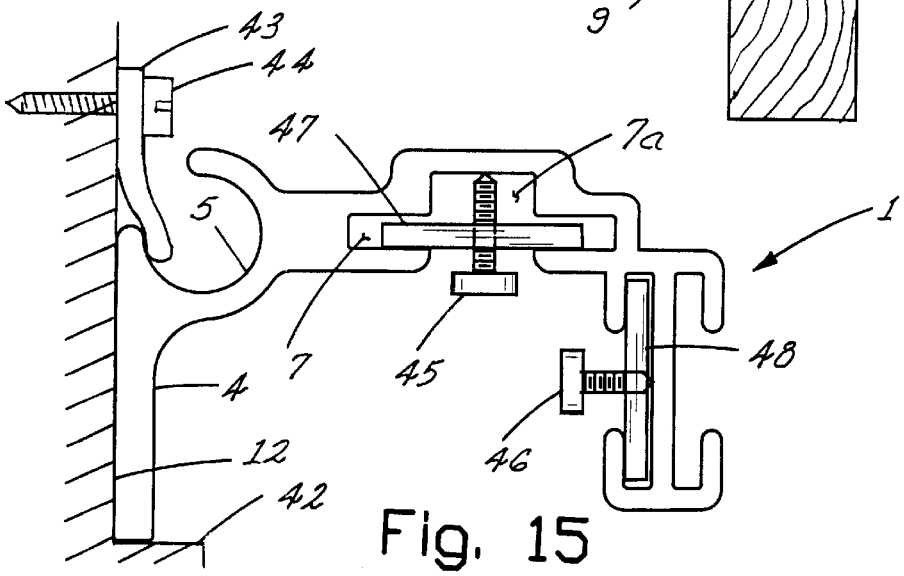
FIG. 15 shows an alternate mounting arrangement for the track of the present invention wherein one leg of the track rests on a ledge and a retainer secures the track in position.

FIG. 15 shows an installation of the track 1 on a ledge 42 and to secure the track 1 in place a retainer 43 held by screw 44 which is screwed into wall 12 completes the mounting of this alternate use of my invention. Included in this illustration in FIG. 15 is locking bolt 45 and nut 47 combinations and locking bolt 46 and nut 48. These locking bolts, nuts, and washers can be used to suspend additional items as required.

Figure 16:
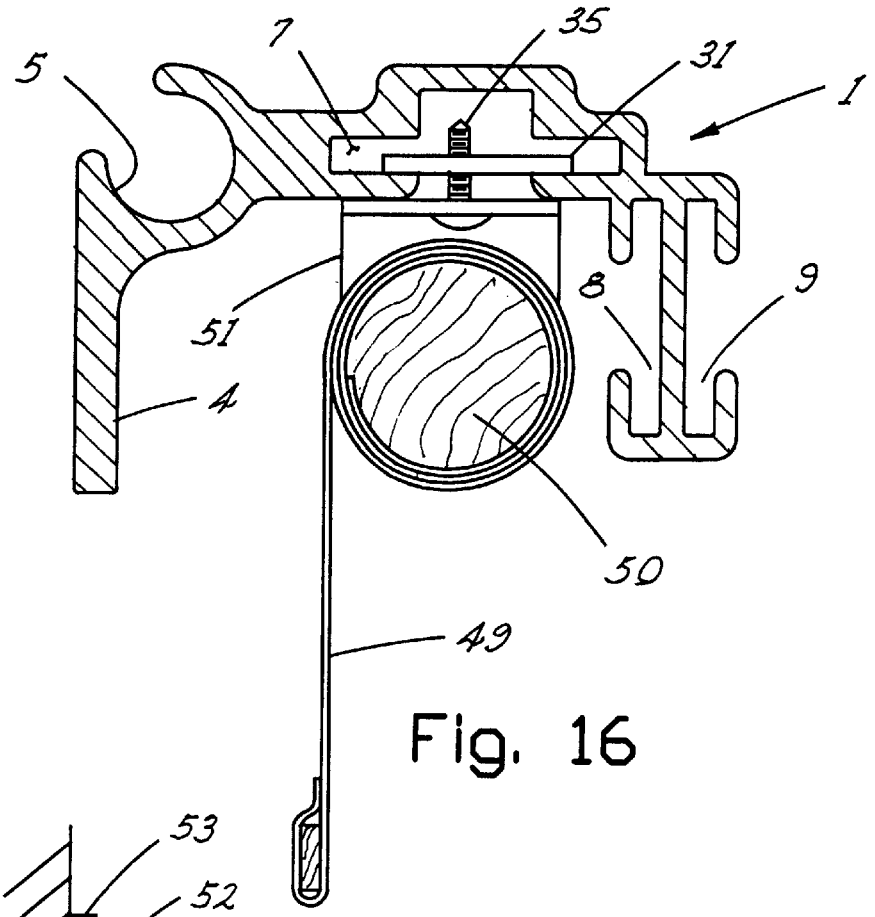
FIG. 16 is a cross-section view of the present invention showing a roll-up shade carried by the track.

Looking now at FIG. 16, a cross-section of the track is shown carrying a roll-up shade 49 which roll upon roll bar 50 that is carried by shade mount 51 secured by bolt 35 and locking washer 31. With the roll-up shade the other mounting tracks are available so a drapery material could be mounted from the dowel holder 5 and also drapes or sheers could be hung form inner and outer slots 8 and 9.

Figure 17:
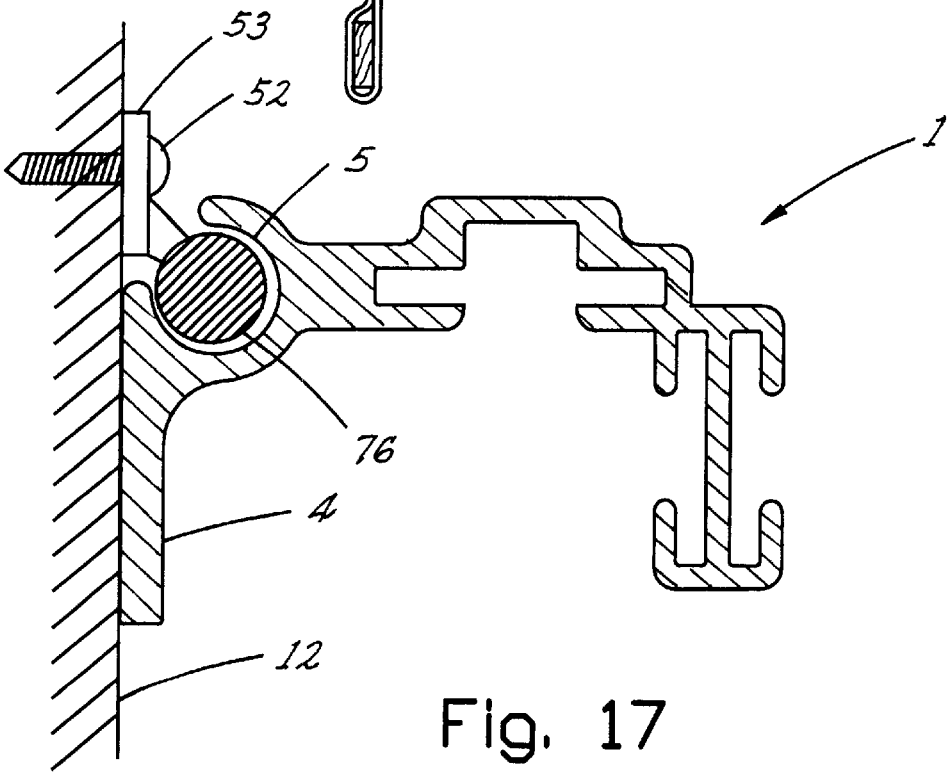
FIG. 17 shows an alternate method of mounting the track by using a dowel like member suspended from a retainer and being a means to suspend the track so that it can be removed easily.

Another alternative mounting means for track 1 is shown in FIG. 17 where a dowel shaped member 76 is held by retainer support 53 which is secured into the wall 12 by screw 52. The dowel holder 5 is used in this configuration as a support means. In this configuration, the cylindrical member 76 is fastened to the wall and the track 1 slides into position parallel to the wall so that it can be readily installed or removed by simply sliding it to the right or left. A series of the cylindrical dowel mounts 76 may be provided for one single bar with mounting at different intervals.

Figure 18:
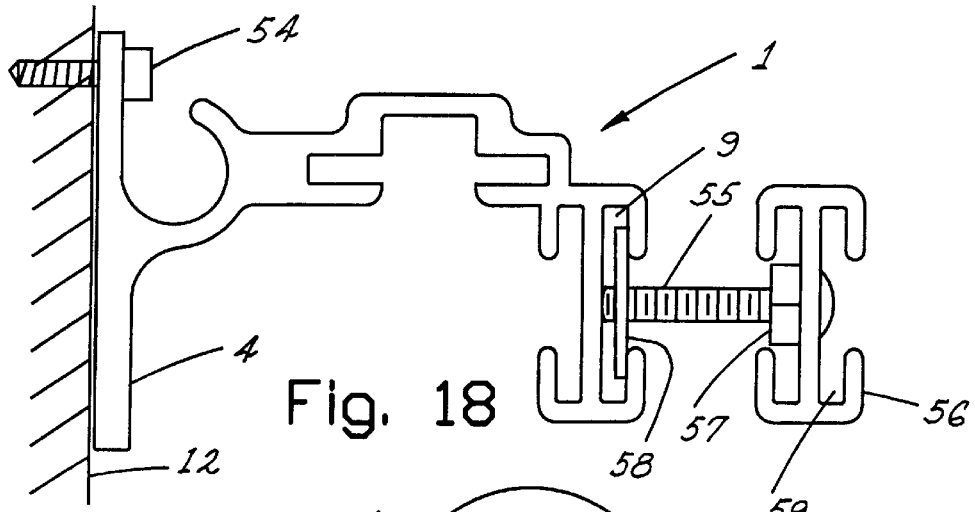
FIG. 18 shows the track of the present invention with an extension arm to provide additional and extended hanging means.

FIG. 18 shows screw 54 securing the universal track to wall 12 and the use of an extender support bolt 55 is shown. The locking nut 57 is the support for the extended slidable member so that support slot 59 is provided at a spaced apart distance from the third support slot 9. The locking nut 58 provides support for the extension. A plurality of these bolts 55, locking nuts 57, and locking retaining washers 55 will be needed down the length of the track.

Figure 19:
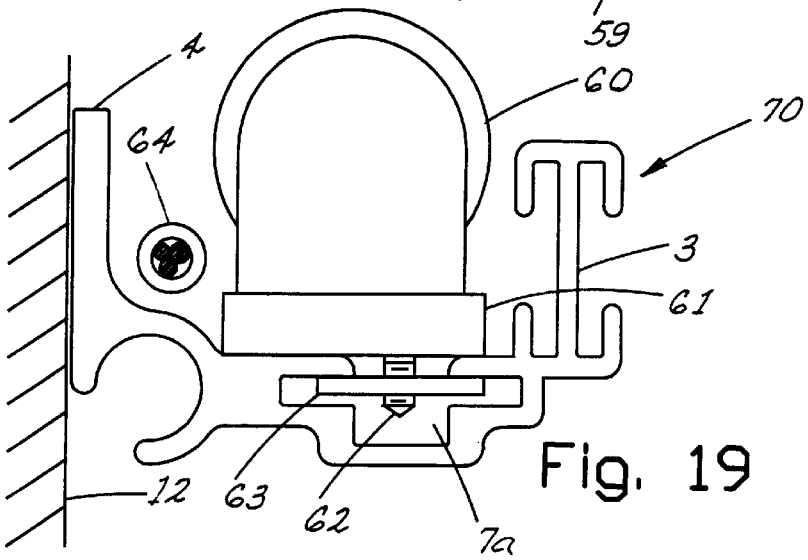
FIG. 19 shows the track of the present invention upside-down serving as a tray for lighting apparatus.

In FIG. 19, the mounting track is inverted to provide a tray for mounting a lighting fixture 60 within the tray. Cable 54 supplies the electric power to the lighting fixture 60 which is supported by lighting track 61 so that its position may be changed as desired. The track 61 is held by retaining nut 63 and securing bolt 62. A securing screw to hold the leg 4 to wall 12 is not shown.

Figure 20:
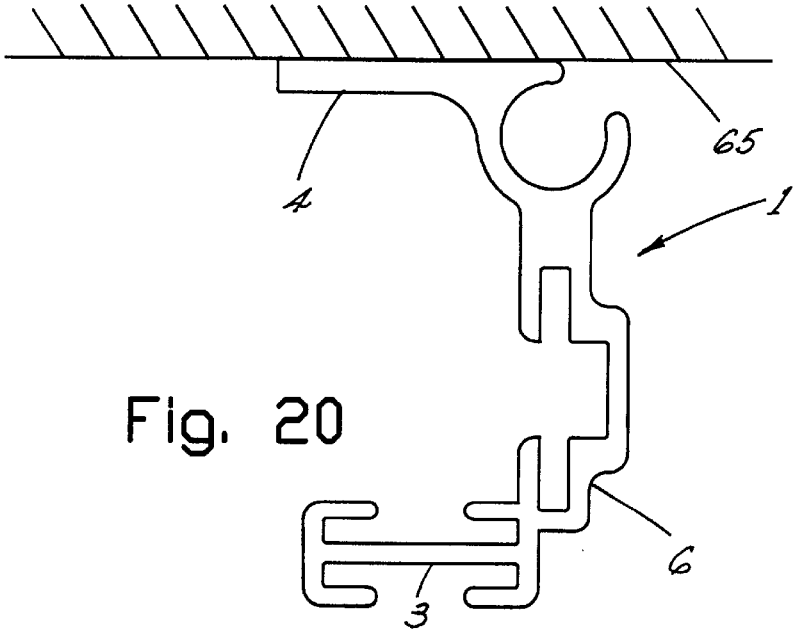
FIG. 20 illustrates the track of the present invention installed in a vertical position.

FIG. 20 shows the universal mounting track when mounted in a vertical position from a ceiling or horizontal support surface. A retaining screw is not shown.

Figure 21:
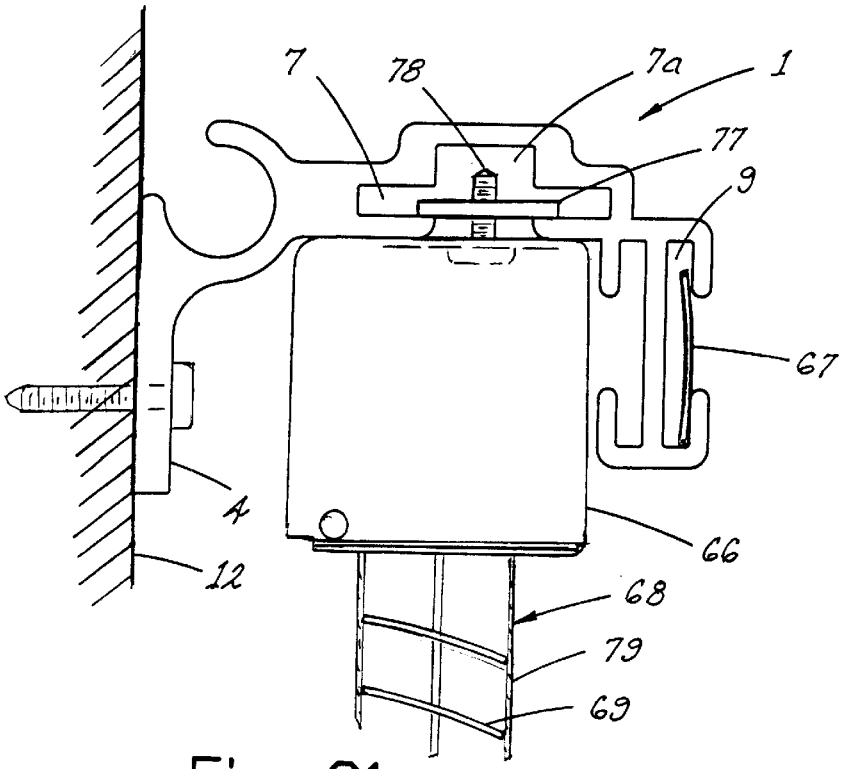
FIG. 21 shows the universal track of the present invention and perspective cross-section of a venetian blind suspension member carried thereby; and, FIG. 22 is a front view of FIG. 21.
Figure 22:
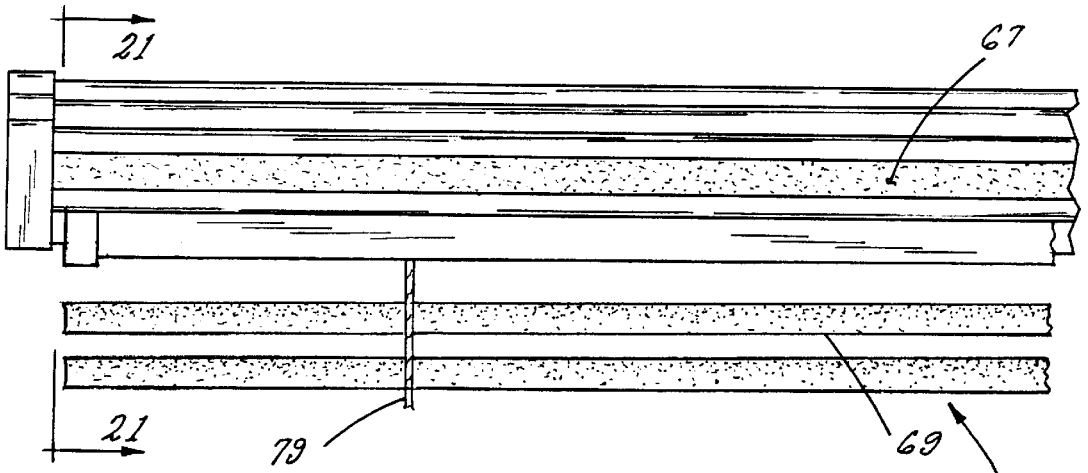

FIGS. 21 and 22 show venetian blinds 68 carried by the venetian blind folding and support unit 66 which in turn is held by retaining washer 77 and bolt 78 in slot 7. The outer slot 9 is filled with insert 67 which is coordinated with the appearance of the blind 69. The blind support with draw string 79 carries the blinds. The front view of the blinds is shown in FIG. 22.

As can be appreciated from the many uses and mounting embodiments of my invention, the one piece construction of aluminum or anodized aluminum offers significant advantages due to its strength, rigidity and durability. The anodized aluminum can provide the mounting track a variety of colors which can match basic wall or window frame colors or be painted on the spot to so match. Metal extrusion is the preferred method of making the mounting track. In addition to using metals, thermoset plastics may be used and extruded or injection molded.

From the foregoing description it should be apparent that a unique and very important aspect of my invention is that my universal track can carry multiple hangings that are functionally suspended. That is, blinds may be adjusted, sheers opened or closed, draperies lifted or lowered, with all being operably suspended from a single track.

Having read and understood the descriptions of my invention and its many alternate possibilities, other uses and alternate designs may become apparent to those skilled in the art but it is understood that my invention is limited only to the scope of the claims that follow.

What is claimed is:

1. A universal mounting track for decorative and functional hangings including draperies, tapestries, blinds, curtains, and sheers comprising:

a) a rigid, elongated base member having a generally U-shaped cross section including a horizontal connector and two spaced apart legs vertically depending from said connector, said base having an inner and outer surface, a portion of the upper surface of said connector being smooth and flat and extending longitudinally the length of said track, said surface portion being the uppermost part of said track;

b) one leg being an inner leg and having a smooth, flat outer surface for contacting a support surface;

c) an elongated dowel holder formed in the outer surface of said base and extending the length of said base, said dowel holder forming the joint between said inner leg and said horizontal connector and having an elongated opening for receiving a dowel therein, said opening facing generally away from the horizontal connecting member and towards the inner leg side of said track whereby when a dowel with fabric therearound is inserted into said holder the fabric can extend out of and over the horizontal connector to cover said mounting track member while being retained by the holder; and, d) the other leg being an outer leg and having at least one elongated slot formed in a surface for receiving and holding a plurality of slidable mounting member therein wherein multiple decorative and functional hangings may be operably suspended by a single track; and e) said track being mountable on either a vertical surface by the inner leg or a horizontal surface by the horizontal connector.

2. The universal mounting track of claim 1 including an elongated mounting slot formed in the inside surface of said horizontal connector.

3. The universal mounting track of claim 2 wherein said outer legs has two elongated mounting slots formed therein, one being in the outer surface of said outer leg and the other being in the inner surface.

4. The universal mounting track of claim 2 including a channel formed in a surface within the horizontal connector mounting slot.

5. The universal mounting track of claim 1 wherein the base is of one piece construction.

6. The universal mounting track of claim 5 wherein the base is a metal extrusion.

7. The universal mounting track of claim 6 wherein the metal is aluminum.

8. A universal mounting track for decorative and functional hangings including draperies, tapestries, blinds, curtains, sheers, and shades comprising:

a) an elongated, continuous, one piece, base frame member having a generally U-shaped cross-section, with two spaced apart vertical legs and a horizontal connector from which said legs extend;

b) one leg being an inner leg and having a substantially smooth outer surface for contact with a support surface;

c) a dowel holder forming a joint between said inner leg and said horizontal connector, said dowel holder being generally cylindrical in shape extending longitudinally the length of said track and having a longitudinal opening facing away from the horizontal connector for receiving and retaining a dowel;

d) a first longitudinal slot formed in the inside surface of said horizontal connector to slidably carry a plurality of mounting members therein; and, e) the other leg being an outer leg and having inner and outer mounting slots formed in the respective inner and outer surfaces of said leg, said slots being designated as the second and third slots respectively whereby when mounted said track provides a multiplicity of choices for mounting said decorative or functional hangings.

9. The mounting track of claim 8 wherein the track is formed from extruded aluminum.

10. The mounting track of claim 9 wherein the aluminum is anodized aluminum.

11. The mounting track of claim 8 wherein the track is formed of an extruded plastic material.

12. The mounting track of claim 8 including a vertical supporting wall surface and a mounting member securing said track to said wall, said track being mounted with said horizontal connector as the uppermost part of said track.

13. The mounting track of claim 8 including a vertical supporting surface and a mounting member securing said leg to said surface, said track being mounted with the horizontal member as the lowermost part of said track.

14. The mounting track of claim 8 including a horizontal supporting surface and a mounting member securing the horizontal member of the track to said horizontal surface.

15. A universal mounting track for decorative and functional hangings including draperies, tapestries, blinds, curtains, and sheers comprising:

a) a flat supporting surface;

b) an elongated base frame having a generally U-shaped cross-section with two generally parallel spaced apart legs and a horizontal connector, said legs being spaced apart and depending downwardly from said connector;

c) one leg being an inner leg and having a substantially smooth surface for contacting the supporting surface;

d) a dowel holder forming a joint between said inner leg and said horizontal connector;

e) a mounting member for securing said inner leg to said supporting surface;

f) said horizontal connector having an inner, downwardly facing surface with a longitudinally extending slot formed therein designated as the first slot, said slot being generally rectangular in cross-section;

g) a channel formed in said first slot, said channel extending co-extensively with said first slot;

h) the other leg being an inner leg and having a second longitudinal mounting slot formed in its inner surface and a third longitudinal mounting slot formed in its outer surface whereby said track provides a multiplicity of options for decorative and functional hangings.

16. The universal mounting track of claim 15 including;

i) a coverlet of decorative flexible material;

ii) a dowel receiving loop formed in one end of said coverlet;

iii) a dowel inserted within said loop;

iv) said dowel within said legs being disposed within said dowel holder with the coverlet being extended from the dowel holder, across the upper surface of the connector and down and below said outer leg to provide decoration covering for said mounting track.

17. The universal mounting track of claim 15 including:

i) a plurality of slidably mounting clips disposed in said first mounting slot, each clip being provided with a mounting hook; and, ii) a decorative material suspended by said hooks.

18. The universal mounting track of claim 15 including:

i) a plurality of slidable mounting clips disposed in said third mounting slot, each clip being provided with a mounting hook; and, ii) a decorative material suspended by said hooks.

19. The universal mounting track of claim 15 wherein the supporting surface is vertical.

20. The universal mounting track of claim 15 where the supporting surface is horizontal.

21. The universal mounting track of claim 15 wherein said track is mounted with said legs extending upwardly wherein said U-shaped base functions as tray.

22. The universal mounting track of claim 21 wherein the upper surface of said connector contacts the supporting surface and is secured thereto by said mounting member.

23. The universal mounting track of claim 15 wherein said mounting surface has a ledge and including a retainer co-operating with said dowel to retain said inner leg when positioned on said ledge.

* * * * *